US006877680B2

(12) United States Patent
Bauer et al.

(10) Patent No.: US 6,877,680 B2
(45) Date of Patent: Apr. 12, 2005

(54) INJECTOR WITH A MAGNET VALVE FOR CONTROLLING AN INJECTION VALVE

(75) Inventors: Ruediger Bauer, Neuenstadt (DE); Rainer Schnatterer, Boennigheim (DE); Mattias Zettl, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 181 days.

(21) Appl. No.: 10/299,896

(22) Filed: Nov. 20, 2002

(65) Prior Publication Data

US 2003/0150930 A1 Aug. 14, 2003

(30) Foreign Application Priority Data

Nov. 30, 2001 (DE) ..... 101 59 003

(51) Int. Cl.[7] ..... B05B 1/30; F02M 59/00; F02M 39/00

(52) U.S. Cl. ..... 239/585.1; 239/585.3; 239/585.4; 239/585.5; 239/533.2; 239/533.3; 239/533.12

(58) Field of Search ..... 239/585.1–585.5, 239/533.2, 533.3, 533.4, 533.12, 124, 126, 88–93; 251/129.15, 129.21, 127

(56) References Cited

U.S. PATENT DOCUMENTS 4,759,330 A * 7/1988 Kato et al. ..... 123/446
4,911,127 A * 3/1990 Perr ..... 123/446
5,842,452 A * 12/1998 Pattanaik ..... 123/467
6,308,689 B1 * 10/2001 Augustin ..... 123/506

FOREIGN PATENT DOCUMENTS

| | | |
|---|---|---|
| DE | 197 08 104 A1 | 3/1998 |
| DE | 196 50 865 A1 | 10/1998 |
| DE | 100 09 037 A1 | 6/2001 |
| JP | 6 147050 | 5/1994 |
| JP | 8 303316 | 11/1996 |

* cited by examiner

*Primary Examiner*—Davis Hwu
(74) *Attorney, Agent, or Firm*—Ronald E. Greigg

(57) ABSTRACT

Disclosed is an injector for fuel injection, with a magnet valve for controlling an injection valve, in which the magnet valve has a movable armature that can be moved onto a valve seat in the lower armature chamber. The lower armature chamber communicates fluidically with the control pressure chamber of the injection valve via bores. Via a return bore, incidental leak fuel quantities can be returned to a tank via the lower armature chamber. To prevent armature recoil upon closure of the valve seat by the armature, it is proposed that means be provided in the injector for reducing pressure fluctuations occurring in the lower armature chamber. Eliminating pressure fluctuations in the lower armature chamber leads to maximal elimination of armature recoil.

4 Claims, 4 Drawing Sheets

INJECTOR WITH A MAGNET VALVE FOR CONTROLLING AN INJECTION VALVE

BACKGROUND OF THE INVENTION

1. Field of the Invention

The invention relates to an injector, in particular for fuel injection, with a magnet valve for controlling an injection valve. Such magnet valves are used to control an injection valve of a fuel injection system that has a nozzle needle whose opening and closing position are controllable by the magnet valve, so that injection bores can be opened to inject fuel.

2. Description of the Prior Art

A known magnet valve has a movable armature, which when the magnet assembly of the magnet valve is supplied with electric current lifts from a valve seat in the lower armature chamber. This valve seat is in turn in fluidic communication with the control pressure chamber of the injection valve via one or more (throttle) bores. When the valve seat opens, the pressure in the control pressure chamber of the injection valve drops, and fluid (pressure medium) flows via the bores in the direction of the valve seat and from there into the lower armature chamber.

When the pressure in the control chamber is dropping, the nozzle needle of the injection valve, which is constantly subjected to a high fuel pressure acting in the opening direction, is put into motion, and as a result the injection bores are opened, and the injector can inject fuel.

A common rail injector (CRI) functions in this known mode of operation, and both a main and a preinjection can be achieved with very short injection times. A magnet valve of this kind is known for instance from German Patent Disclosure DE 196 50 865 A1.

Known injectors of the generic type in question also have a return bore, which leads to the lower armature chamber and through which fuel quantities from various portions of the magnet valve and injection valve are returned to the lower armature chamber.

If current is no longer supplied to the magnet valve, then the armature moves downward in response to the restoring force of a restoring spring, and closes the valve seat that leads to the outlet throttle. As a result, the pressure in the control chamber increases again, so that the nozzle needle is moved downward and the injection bores are closed.

When the armature takes a seat on the valve seat, the armature recoils, causing it to open the valve seat again and causing a brief pressure reduction in the control chamber. This delays the closure of the nozzle needle. The armature recoil leads overall to a course of the armature stroke that is approximately equivalent to a damped vibration. This leads to a delayed closure of the nozzle needle, which is disadvantageous particularly if a rapid switching sequence of the magnet valve (preinjections and main injection) is wanted, and which is moreover expressed in a worsening of the emissions and noise values of the engine.

In German Patent Disclosure DE 197 08 104 A1, it is proposed, for reducing armature recoil in a generic magnet valve, to provide a damping device, which cooperates with the movable armature and a stationary part and leads to damping of the after-vibration of the armature. By means of a special embodiment of the armature plate, the armature guide stub, and the sliding part in which the armature bolt extends, various damping devices are achieved in this reference, and interposed adjusting shims can enhance the damping effect. However, especially in one-piece armatures, this principle has proved to be too expensive, and on its own it is not always adequate.

OBJECT AND SUMMARY OF THE INVENTION

The injector of the invention has means for reducing pressure fluctuations that occur in the lower armature chamber. It has in fact been demonstrated that pressure surges in the lower armature chamber, which through the bore in the armature guide act directly on the armature face, cause the armature to lift from the valve seat and thus result in a delayed closure of the nozzle needle. By reducing the pressure fluctuations in the lower armature chamber, the armature recoil can therefore be reduced to a minimum, and thus a continuous closure of the nozzle needle can be assured.

The intensity of the armature recoil depends in fact on the return counterpressure (the pressure of the fuel quantities returned via the return bore), which for reasons of system requirements falls within a certain range of variation. Because of the reduction of pressure fluctuations in the lower armature chamber that is achieved according to the invention, pressure fluctuations propagating from the return bore into the lower armature chamber can therefore be compensated for, and thus the intensity of the armature recoil can be reduced sharply.

The means for reducing pressure fluctuations in the lower armature chamber can include recesses or built-in components to be machined into it, by means of which an increased volume of the return bore and/or of the lower armature chamber is achieved. In general, certain portions, affected by the return of the fuel quantities, in both the magnet valve and the injection valve can be embodied with an increased volume. Such an increase in volume brings about a reduction in the pressure and thus a lessening of pressure surges.

Another provision for reducing pressure fluctuations in the lower armature chamber is to build a throttle into the return bore upstream of the lower armature chamber.

The invention leads to a course of the armature stroke which is severely damped, compared to the course in known magnet valves, so that armature recoil is hardly noticeable any longer. Accordingly the course of the needle stroke of the nozzle needle is continuous, so that the nozzle needle moves without delay, continuously, into its closing position. This improves the noise and emissions values of the engine. Moreover, the injection quantity no longer varies as a function of the return counterpressure and as a result the performance values of the engine are improved along with its noise and emissions values.

The undefined recoil of the armature and thus the undefined closure of the nozzle needle, in the prior art, cause a major variation in the injection quantity from one stroke to another. The continuous closure of the nozzle needle achieved by means of the invention thus brings about less variation in the injection quantity from stroke to stroke. Finally, for reasons of emissions and noise, there is also a need to be able to provide a plurality of injections in rapid succession. This is possible only if the armature does not recoil further, or comes quickly to a stop. By means of the invention, the spacing between successive injections can be shortened, since the nozzle needle moves continuously into its closing position without delay.

BRIEF DESCRIPTION OF THE DRAWINGS

The invention will be better understood and further objects and advantages thereof will become more apparent from the ensuing detailed description of a preferred embodiment taken in conjunction with the drawings, in which.

DESCRIPTION OF THE PREFERRED EMBODIMENT

Figure 1:
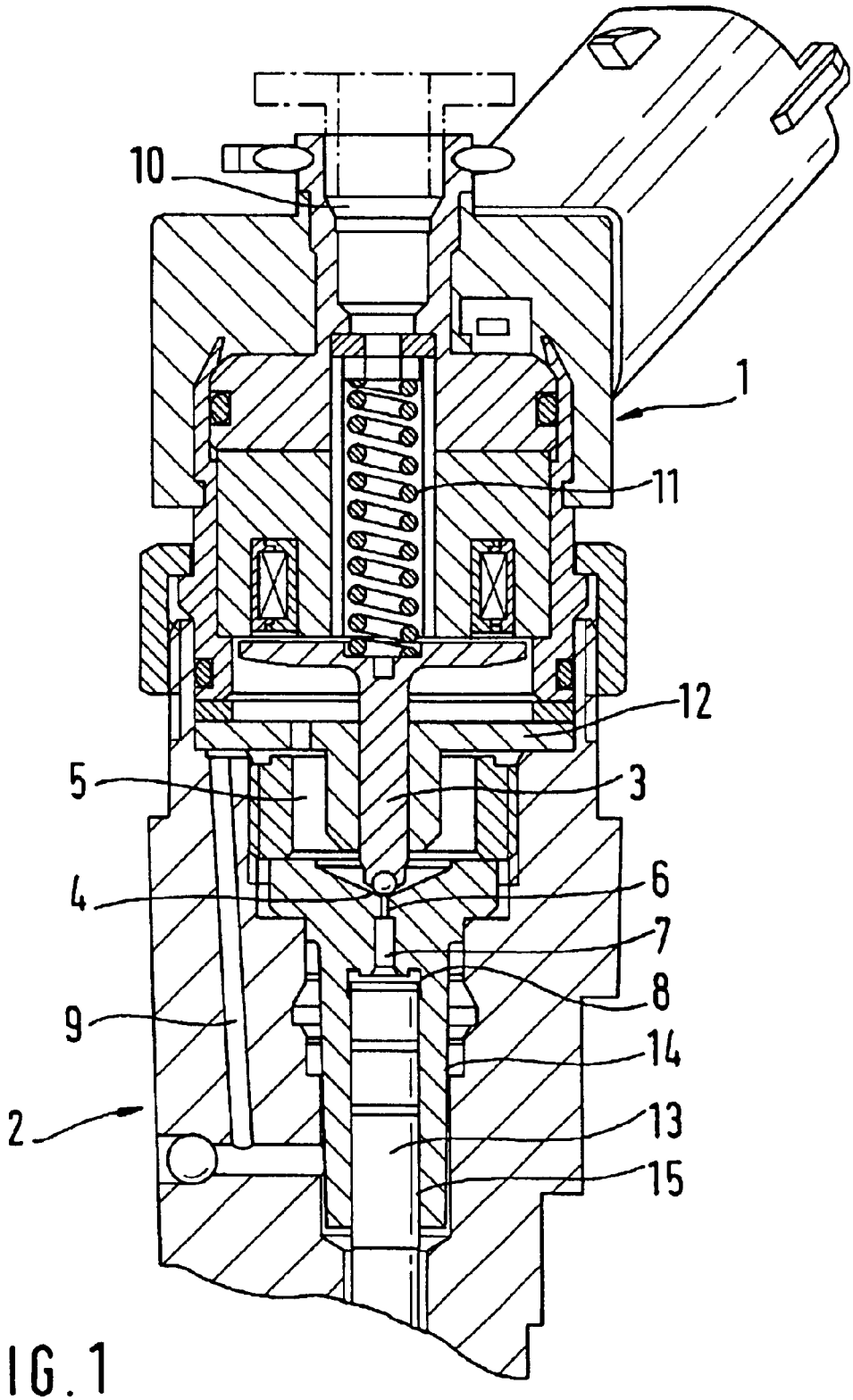
FIG. 1 is a fragmentary sectional view showing the upper part of an injector with a magnet valve and the upper part of the injection valve.

FIG. 1 shows the usual design of an injector, of the kind used particularly for fuel injection in common rail systems, comprising a magnet valve 1 and an injection valve 2. In the sketch, only the parts of the injector that are essential to the invention are identified by reference numeral. The one-piece armature 3 is drawn upward, counter to the spring force of the armature spring 11 as a result of supplying current to the magnet valve 1. The armature 3 travels in the armature guide 12, and when no current is supplied to the magnet valve 1, the armature rests on the valve seat 4 of the injection valve 2. In this state, the fluid communication is interrupted with the control pressure chamber 8 of the injection valve 2 by closing off the outlet throttle 6 and the bore 7. When the magnet valve is supplied with current, conversely, the outlet throttle 6 opens, and the pressure in the control pressure chamber 8 drops, since fluid can now flow from the control pressure chamber 8 into the lower armature chamber 5. The inflow into the control pressure chamber is limited by the inlet throttle (not shown), while conversely the nozzle needle 17 (see FIG. 2) is constantly exposed to a high fuel pressure acting in the opening direction. Since with the outlet throttle 6 open the pressure in the control pressure chamber 8 becomes less than the high fuel pressure applied to the nozzle needle 17, the thrust rod 13 begins to move and pulls the nozzle needle 17 in the opening direction, as a result of which the injection valves can be opened and the injector can inject fuel.

Figure 2:
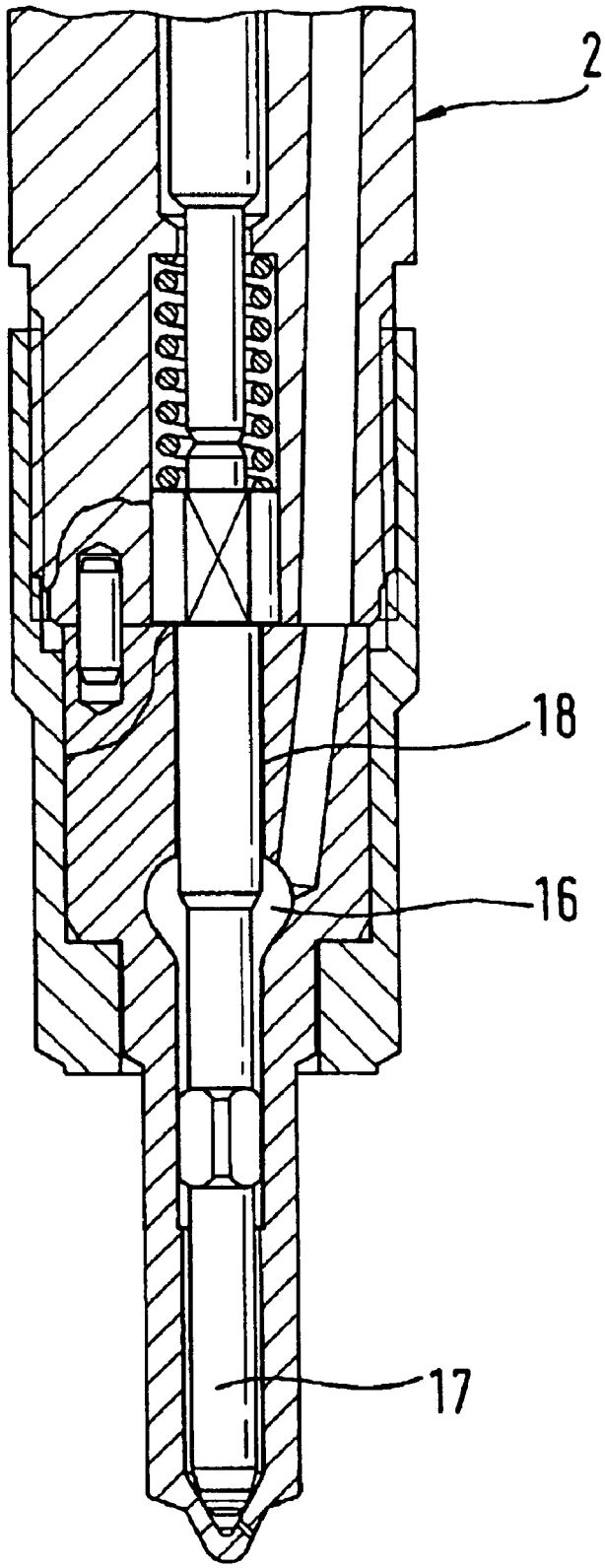
FIG. 2 shows the lower part of the injection valve.

FIG. 2 shows the lower part of the injection valve 2 that belongs to the injector; once again, only some parts are identified by reference numeral. The nozzle needle 17 is connected to the thrust rod 13 of FIG. 1. The lower nozzle needle chamber is marked 16.

At various points of the injector, fuel quantities occur, which are returned to the lower armature chamber 5 via the return bore 9. These fuel quantities occur where the valve element is sealed off from the injector body, at the point marked 14, as well as at the point 15 between the thrust rod 13 and the valve element and at the point 18 between the nozzle and the nozzle needle (see FIGS. 1 and 2). In addition to the fuel quantity, the control quantity from the outlet throttle 6 is returned from the injector to the tank through the bore of the armature guide 12, via the entire return system 10.

The injector described in conjunction with FIGS. 1 and 2 has the aforementioned disadvantage of armature recoil. That is, if the magnet valve 1 no longer receives electric current, the armature 3 taking a seat on the valve seat 4 does not come to rest immediately but instead recoils, which briefly re-opens the communication between the outlet throttle 6 and the lower armature chamber 5. The result is a brief pressure drop in the control pressure chamber 8, and thus a delayed closure of the nozzle needle 17.

Figure 4:
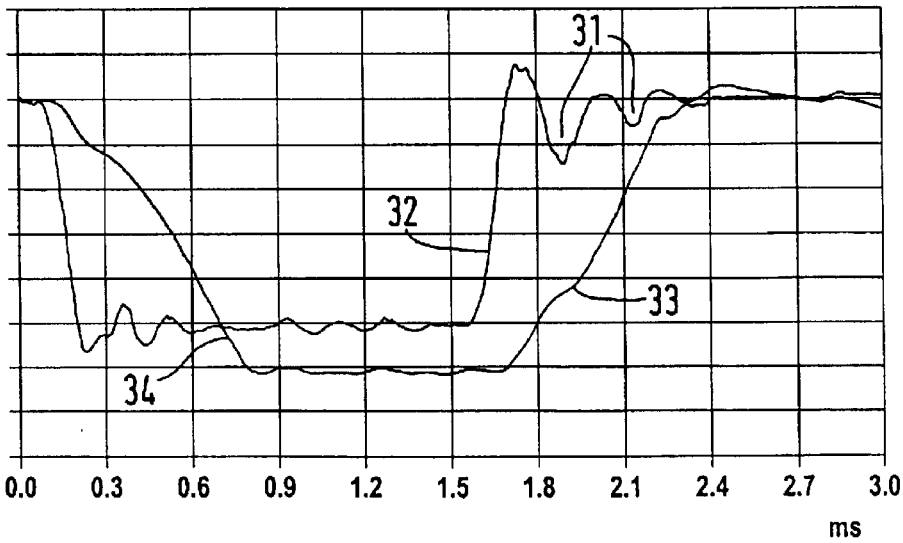
FIG. 4 is a graph showing the course over time of the armature stroke and needle stroke in the known injector.

The course over time of this process is shown in FIG. 4. The needle stroke is marked 34, and the armature stroke is marked 32. The armature recoil upon closure of the magnet valve leads to brief opening periods 31, and in this range the course of the armature stroke is approximately equivalent to that of a damped vibration. The course of the needle stroke of the nozzle needle 17 is consequently not linear but instead has delays 33.

Figure 3:
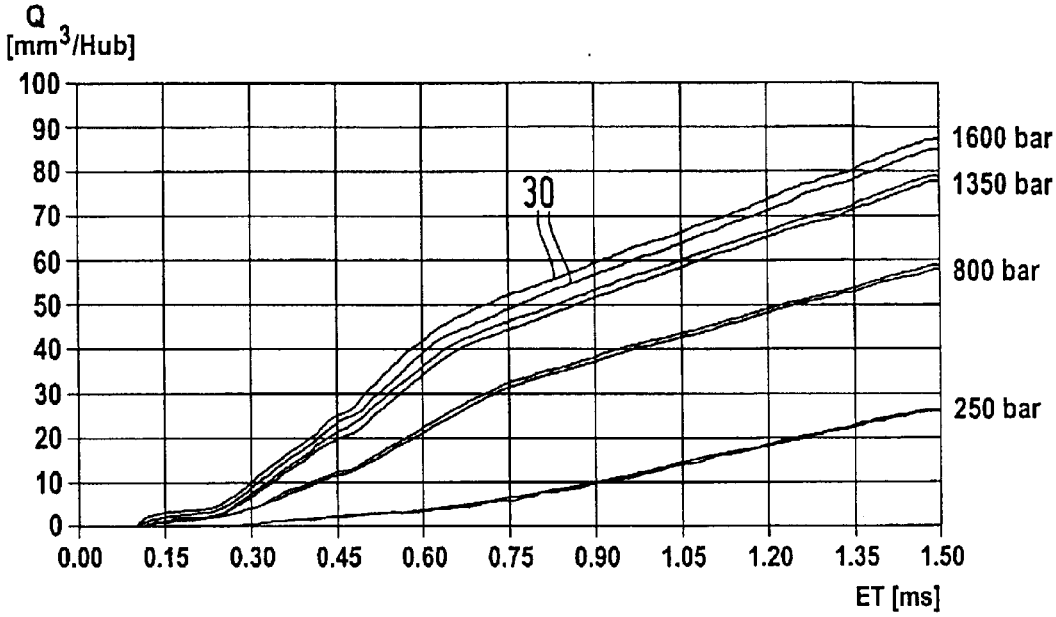
FIG. 3 is a graph showing the dependency of the injection quantity on the return counterpressure in known injectors.

It has been found that the injection quantities depend on the return counterpressure. The relationship is shown in FIG. 3, in which the injection quantity Q (in units of volume per needle stroke) is plotted over the injection time ET (in milliseconds) for various return counterpressures. The curves 30 show different injection quantities, upon a variation in the return counterpressure around 1600 bar. Fluctuations in the return counterpressure affect the intensity of the armature recoil, since these pressure fluctuations, via the lower armature chamber 5 and the bores in the armature guide 12, act directly on the armature face.

According to the invention, the pressure fluctuations in the lower armature chamber 5 are now reduced by providing that by structural provisions and a corresponding design, the volumes of the portions affected by the return of the fuel quantities are enlarged. In the simplest case, the return bore 9 and/or the lower armature chamber 5 itself are increased in their volume. Inserting a throttle into the return bore 9 upstream of the lower armature chamber 5 is also suitable for reducing pressure fluctuations in the lower armature chamber 5. The provisions described above can also be used in combination.

Figure 5:
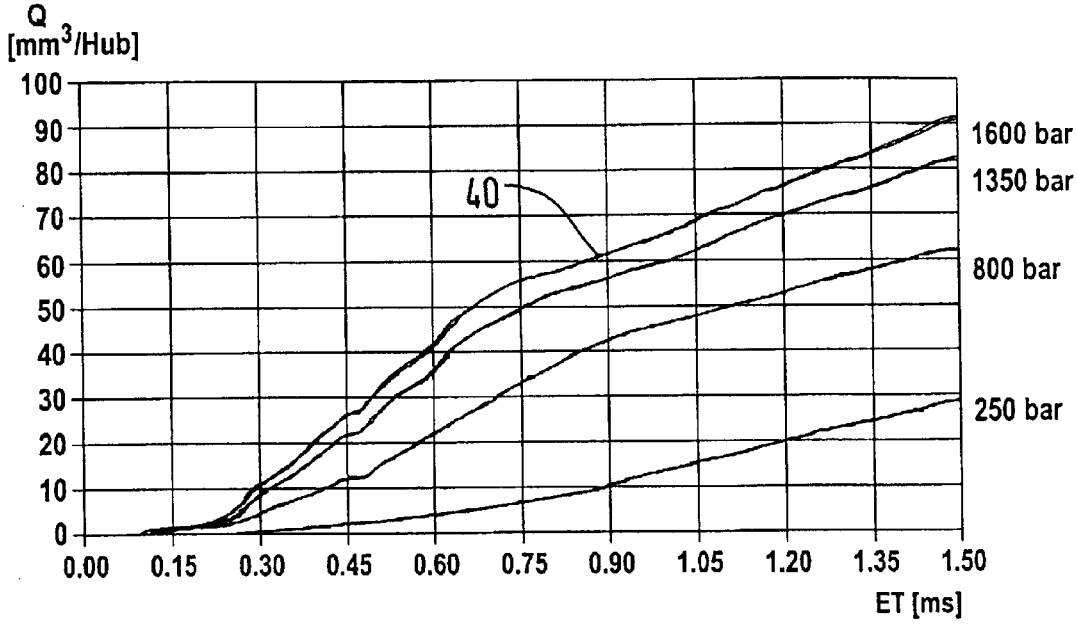
FIG. 5 shows the dependency of the injection quantity on the return counterpressure in the injector optimized according to the invention.
Figure 6:
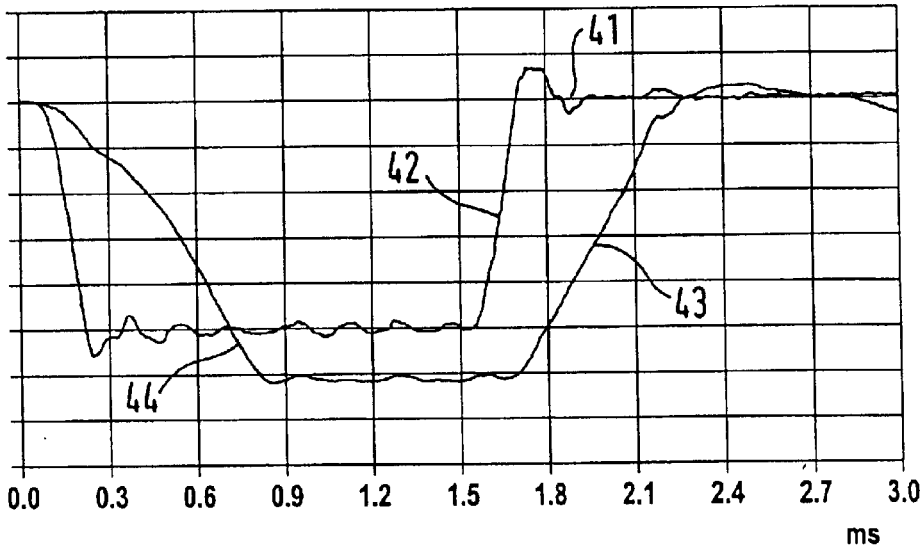
FIG. 6 shows the course over time of the armature stroke and needle stroke in the injector optimized according to the invention.

FIGS. 5 and 6 show analogous views to FIGS. 3 and 4, for an injector that is now optimized according to the invention. In variations in the return counterpressure in the vicinity of 1600 bar, the injection quantity (curve 40) remains unchanged, as can be seen from FIG. 5. Correspondingly, the course of the needle stroke 43 is linear in FIG. 6; that is, the nozzle needle closes continuously, without delay. The course of the needle stroke is marked 44 in FIG. 6. The armature stroke 42, in the injector of the invention, exhibits substantially reduced armature recoil 41. The duration and intensity of opening of the armature after the current supply to the magnet valve is switched off are reduced markedly, in comparison to the course in FIG. 4.

The injector of the invention improves the noise, emissions, and performance values of the engine by assuring a continuous closure of the nozzle needle and eliminating the dependency of the injection quantity on fluctuations in the return counterpressure. The defined closure of the nozzle of the injection valve brings about reduced variations in the injection quantity from one stroke to another, and the spacing between successive injections can be shortened, in comparison to conventional injectors.

The foregoing relates to a preferred exemplary embodiment of the invention, it being understood that other variants and embodiments thereof are possible within the spirit and scope of the invention, the latter being defined by the appended claims.

We claim:

1. In an injector for fuel injection, with a magnet valve (1) for controlling an injection valve (2), in which the magnet valve (1) has a movable armature (3) that can be moved onto a valve seat (4) in the lower armature chamber (5), which chamber in turn is in fluid communication, via one or more bores (6, 7), with a control pressure chamber (8) of the injection valve (2), and in which a return bore (9), leading to the lower armature chamber (5), is provided in the injector for returning leak fuel quantities to the lower armature chamber (5), the improvement comprising means for reducing pressure fluctuations occurring in the lower armature chamber (5).

2. The injector according to claim 1 wherein one or more of the portions of the injector that are affected by the return of the leak fuel quantities, such as the return bore (9) and the lower armature chamber (5), are embodied with an enlarged volume by means of recesses or built-in components to be machined into them.

3. The injector according to claim 1 wherein the means for reducing pressure fluctuation comprising a throttle built in the return bore (9) upstream of the lower armature chamber (5).

4. The injector according to claim 2 wherein the means for reducing pressure fluctuation comprising a throttle built in the return bore (9) upstream of the lower armature chamber (5).

* * * * *